United States Patent [19]

Malden

[11] 4,106,949

[45] Aug. 15, 1978

[54] TREATMENT OF CLAY MINERAL PIGMENT

[75] Inventor: Peter James Malden, Lostwithiel, England

[73] Assignee: English Clays Lovering Pochin & Company, Limited, Austin, England

[21] Appl. No.: 518,970

[22] Filed: Oct. 29, 1974

[30] Foreign Application Priority Data

Nov. 2, 1973 [GB] United Kingdom ..... 51119/73

[51] Int. Cl.[2] ..... C09C 1/42

[52] U.S. Cl. ..... 106/288 B; 106/72; 106/308 N

[58] Field of Search ..... 106/72, 286, 308 N, 106/DIG. 4, 288 B; 162/181 D; 428/537

[56] References Cited

U.S. PATENT DOCUMENTS

| | | | |
|---|---|---|---|
| 2,425,231 | 8/1947 | Dickerman et al. | 428/537 |
| 2,537,114 | 1/1951 | Young et al. | 428/537 |
| 2,899,330 | 8/1959 | Lyons | 106/72 X |
| 2,982,665 | 5/1961 | Wilcox | 106/72 X |
| 3,156,576 | 11/1964 | Grotenhuis | 106/308 N |
| 3,184,373 | 5/1965 | Arledter | 162/181 D X |
| 3,252,852 | 5/1966 | Legally | 106/308 N |
| 3,301,691 | 1/1967 | Hemstock et al. | 106/72 |
| 3,309,211 | 3/1967 | Weiss et al. | 106/288 B |
| 3,338,164 | 8/1967 | Webers | 101/457 |
| 3,455,717 | 7/1969 | Debus | 106/308 N X |
| 3,628,738 | 12/1971 | Mitchell et al. | 106/308 N |
| 3,655,608 | 4/1972 | Guenther et al. | 106/308 N X |
| 3,737,333 | 6/1973 | Sawyer | 106/288 B |
| 3,925,095 | 12/1975 | Bockmann et al. | 106/308 N |

OTHER PUBLICATIONS

Rose, *The Condensed Chemical Dictionary,* Seventh Ed., N.Y., Van Nostrand Reinhold Co., 1966, p. 233.

*Primary Examiner*—Allan Lieberman
*Attorney, Agent, or Firm*—Armstrong, Nikaido, Marmelstein & Kubovcik

[57] ABSTRACT

The invention provides a process for improving the rheological properties of an aqueous suspension of a clay mineral in which the aqueous suspension is mixed with a water-soluble organic compound having a plurality of basic groups and a number average molecular weight not greater than 1,000. The treated clay minerals may be used, for example, as the pigment in a paper coating composition.

13 Claims, No Drawings

TREATMENT OF CLAY MINERAL PIGMENT

BACKGROUND OF THE INVENTION

This invention relates to the treatment of minerals and, more particularly but not exclusively, is concerned with the treatment of clay minerals.

A conventional way of improving the smoothness, printability and whiteness of paper is to apply to the surface of the paper a coating composition, which comprises an aqueous suspension of a white pigment, conveniently a kaolinitic clay, an adhesive and water. In order that the coating composition may be smoothed on to the paper it must be capable of flowing at least to a limited extent but, since any water in the composition must be removed by thermal drying, it is advantageous that the water content of the composition should be as low as possible.

Is is an object of this invention to provide inter alia a clay mineral which has desirable properties when used as a pigment in a paper coating composition; a process for treating an aqueous suspension of a clay mineral so as to improve the rheological properties of the clay mineral in aqueous suspension; and a process for treating an aqueous suspension of a clay mineral so that the clay mineral forms a cake of high permeability to water during a filtration operation so that the rate at which the aqueous suspension may be dewatered by filtration is increased.

SUMMARY OF THE INVENTION

Accordingly, the present invention provides a process for improving the rheological properties of an aqueous suspension of a clay mineral, which process comprises the step of mixing the aqueous suspension of the clay mineral with a minor amount by weight of a water-soluble organic compound having a plurality of basic groups and a number average molecular weight not greater than 1000.

A further improvement in the rheological properties of the clay mineral may be obtained by subjecting clay mineral treated as defined above to mechanical working in, for example, an auger-type pugmill, a Z-blade mixer, an edge-runner mill or a similar machine for working plastic materials. It is preferable to dissipate in the treated clay mineral from 25 to 1000 KJ of energy per kg of dry clay mineral.

An aqueous suspension of the clay mineral which has been treated by the process of the invention remains fluid at water contents lower than that value at which an aqueous suspension of the untreated clay mineral ceases to be fluid.

DESCRIPTION OF THE PREFERRED EMBODIMENTS

The water-soluble organic compounds which may be used in the process of the invention may be described as polyacidic organic bases. The compound presently preferred is a polyethylene imine having a number average molecular weight in the range 400 to 1000, but useful results may also be obtained with other polyamines, for example ethylenediamine, 1:12 dodecanediamine, diethylenetriamine, tetraethylene pentamine, hydrazine and hexamethylene tetramine. Two or more of the water-soluble organic compounds may be used together if so desired.

Advantageously, the water-soluble organic compound is mixed with the aqueous suspension of the clay mineral in the form of a dilute aqueous solution, especially when the organic compound has a number average molecular weight of 500 or more, since a solution containing more than about 20% w/v of such an organic compound would have a high viscosity which would not allow the solution to be pumped economically. The concentration of the water-soluble organic compound having a number average molecular weight of 500 or more in the aqueous solution should preferably be from 0.1 to 20% w/v, more preferably from 0.5 to 5% w/v.

The amount of the organic compound added to the aqueous suspension of the clay mineral should not normally be more than 1%, and preferably not more than about 0.25% by weight based on the weight of dry clay mineral because of its high cost. Quantities of organic compound in excess of 0.25% by weight may be required for the treatment of clays which, in the untreated state, form aqueous suspensions of high viscosity.

The solids content of the aqueous suspension of the clay mineral should preferably be in the range of from 5 to 30% by weight, more preferably from 8 to 20% by weight.

The pH of the aqueous suspension of the clay mineral should preferably be in the range from 2.8 to 7.5, more preferably from 4.5 to 6.0 during the mixing thereof with the organic compound and, when the organic compound is added in the form of an aqueous solution, its pH is preferably adjusted by the addition thereto of a dilute acid to a value in the range from 4.5 to 6.0 prior to mixing with the aqueous suspension of the clay mineral.

The process of the invention can be conveniently applied to clay minerals of the kandite group, e.g. kaolinite, dickite, nacrite or halloysite; clay minerals of the smectite group, e.g., montmorillonite, beidellite and saponite; and mica-like clay minerals, e.g., illites.

The invention is illustrated by the following Examples.

EXAMPLE 1

There was prepared an aqueous suspension containing 9.4% by weight of a clay mineral which was a kaolin which had been refined, using sodium silicate as a deflocculant, so as to have particle size distribution such that 80% by weight consisted of particles smaller than 2 microns equivalent spherical diameter. The pH of the aqueous suspension was adjusted to 4.5 with dilute sulphuric acid. An aqueous solution containing 1% w/v of a polyethylene imine manufactured by the Dow Chemical Company, U.S.A. under the brand name "PEI 6" and having a number average molecular weight of 600 was prepared and its pH was adjusted to 6.0 with dilute sulphuric acid. The polyethylene imine used is believed to be a highly branched polyamine which can be prepared by the acid catalysed polymerisation of the monomer, ethylenimine, and which has the general empirical formula $(C_2H_5N)_n$. 1500 ml of the aqueous suspension, containing 150 g. of dry kaolin, was mixed with vigorous stirring with 7.5 ml of the aqueous solution. The resulting mixture was stirred for ½ minute, filtered and the cake of treated kaolin thus obtained dried at 80° C. to zero moisture content. The amount of polyethylene imine added to the kaolin was equivalent to 0.05% by weight based on the weight of dry kaolin.

This experiment was repeated three more times using amounts of polyethylene imine equivalent to 0.1%, 0.15% and 0.20% by weight respectively based on the weight of dry kaolin.

The 5 poise viscosity concentration of the original untreated kaolin and of each of the samples of treated kaolin was then measured. (The 5 poise viscosity concentration is the percentage by weight of dry kaolin in a fully deflocculated aqueous suspension which has a viscosity of 5 poise at 22° C). The results obtained are set forth in Table I below.

Table I

| Amount of polyethylene imine (% by wt. based on wt. of dry kaolin) | 5 poise viscosity concentration |
|---|---|
| 0 | 67.8 |
| 0.05 | 68.7 |
| 0.10 | 69.1 |
| 0.15 | 68.2 |
| 0.20 | 64.7 |

EXAMPLE 2

A sample of a clay mineral which was a kaolin, which had been refined (using as the deflocculant a sodium polyacrylate having a number average molecular weight of 1650 so that no free silicate was introduced) so as to have a particle size distribution such that 80% by weight consisted of particles smaller than 2 microns equivalent spherical diameter, was treated with the same polyethylene imine and in the same manner as described in Example 1. The 5 poise viscosity concentration was measured for the untreated and treated kaolin samples. The results obtained are set forth in Table II below.

Table II

| Amount of polyethylene imine (% by wt. based on wt. of dry kaolin) | 5 poise viscosity concentration |
|---|---|
| 0 | 66.2 |
| 0.05 | 67.8 |
| 0.10 | 68.6 |
| 0.15 | 69.6 |
| 0.20 | 68.1 |

EXAMPLE 3

The same kaolin as was used in Example 2 was treated in the same way as described in that Example except that organic compounds other than the polyethylene imine were employed. Thus, there was mixed with one sample of the kaolin suspension an aqueous solution containing 0.05% by weight of ethylenediamine; to another sample of the kaolin suspension 0.05% by weight of diethylene triamine; and to a third sample of the kaolin suspension 0.1% by weight of hexamethylene tetramine (these percentages being based on the weight of dry kaolin). The 5 poise viscosity concentration was measured for each of the treated samples of kaolin and the results are set forth in Table III below together with the corresponding results from Example 2 for comparison.

Table III

| | 5 poise viscosity concentration |
|---|---|
| Untreated kaolin | 66.2 |
| Kaolin treated with 0.05% w/w of polyethylene imine | 67.8 |
| Kaolin treated with 0.05% w/w of ethylenediamine | 67.5 |
| Kaolin treated with 0.05% w/w of diethylene triamine | 67.8 |
| Kaolin treated with 0.1% w/w of hexamethylene tetramine | 66.7 |

These results show that when kaolin has been refined in the absence of free silicate, treatment of the kaolin by the process of the invention with ethylenediamine, diethylenetriamine or with hexamethylene tetramine shows improvements in the 5 poise viscosity concentration value similar, in the first two cases, to those obtained when the organic base introduced is polyethylene imine.

EXAMPLE 4

The same kaolin as was used in Example 1 was refined and treated in the same manner as in Example 1 but with varying amounts of the polyethylene imine having a number average molecular weight of 600 used in Example 1; diethylene triamine; or with tetraethylene pentamine. The 5 poise viscosity concentration was measured for each resulting sample of treated kaolin and the results obtained together with that from an untreated sample of kaolin are set forth in Table IV below.

Table IV

| Amount of organic compound (% by wt. based on wt. of dry kaolin) | 5 poise viscosity concentration Polyethylene imine | Diethylene triamine | Tetraethylene Bentamine |
|---|---|---|---|
| 0 | 67.8 | 67.8 | 67.8 |
| 0.05 | 68.7 | 68.4 | 68.5 |
| 0.10 | 69.1 | 68.3 | 67.9 |
| 0.15 | 68.2 | 68.1 | — |

These results show that when kaolin has been refined using sodium silicate as the deflocculant the results obtained with diethylene triamine are slightly inferior to those obtained with polyethylene imine. They also show that tetraethylene pentamine provides a useful improvement in the 5 poise viscosity concentration provided that the dose is carefully controlled so as to be at or near the optimum of 0.05% by weight.

EXAMPLE 5

A kaolin which had been refined using sodium silicate as the deflocculant and then washed by filtering of the suspension and reslurrying of the cake in distilled water had a particle size distribution such that 75% by weight consisted of particles smaller than 2 microns equivalent spherical diameter. This kaolin was treated in the same manner as described in Examppe 1, there being mixed with the kaolin suspension an amount of either the same polyethylene imine having a number average molecular weight of 600 as used in Example 1 or diethylene triamine, as shown in Table V below. The 5 poise viscosity concentration was measured for each sample of kaolin and the results obtained are set forth in Table V below.

Table V

| Amount of organic compound (% by wt. based on wt. of dry kaolin) | 5 poise viscosity concentration Polyethylenimine | Diethylenetriamine |
|---|---|---|
| 0 | 69.8 | 69.8 |
| 0.05 | 70.0 | 70.3 |
| 0.10 | 70.8 | 70.0 |

Table V-continued

| Amount of organic compound (% by wt. based on wt. of dry kaolin) | 5 poise viscosity concentration Polyethylen-imine | Diethylene-triamine |
|---|---|---|
| 0.15 | 68.4 | 70.1 |

These results show that even after the kaolin has been washed to remove the major part of the free silicate, polyethylene imine gives a better optimum improvement in 5 poise viscosity concentration than does the diethylene triamine.

EXAMPLE 6

A kaolin, which in its raw state gave a slurry of high viscosity when mixed with water, was refined using the same sodium polyacrylate deflocculant as was used in Example 2 so as to have a particle size distribution such that 80% by weight consisted of particles smaller than 2 microns equivalent spherical diameter. The deflocculated aqueous suspension of refined kaolin was treated with the same polyethylene imine and in the same manner as described in Example 1. The 5 poise viscosity concentration was measured for the untreated and treated kaolin samples and the results obtained are set forth in Table VI below.

Table VI

| Amount of polyethylene imine (% by wt. based on wt. of dry kaolin) | 5 poise viscosity concentration |
|---|---|
| 0 | 45.0 |
| 0.10 | 49.1 |
| 0.20 | 53.1 |
| 0.40 | 62.6 |
| 0.60 | 54.0 |

A further sample of the kaolin was treated in an identical manner with 0.2% by weight of 1:12 dodecanediamine based on the weight of dry kaolin. The 5 poise viscosity concentration was increased to 55.6%.

Yet another sample of the kaolin was treated in an identical manner with 0.05% by weight of hydrazine based on the weight of dry kaolin. The 5 poise viscosity concentration was increased to 50.0%.

These results demonstrate that a useful improvement in 5 poise viscosity concentration can be achieved by the process of this invention even when the initial viscosity of the aqueous suspension of the kaolin is high.

EXAMPLE 7

The same kaolin as was used in Example 2 was refined using the sodium polyacrylate deflocculant which was described in Example 2 so as to have a particle size distribution such that 80% by weight consisted of particles smaller than 2 microns equivalent spherical diameter. The resultant aqueous suspension of refined kaolin had a solids content of 10% by weight and its pH was adjusted to 4.5 with dilute sulphuric acid. The aqueous suspension was then divided into two portions and each portion was treated with an aqueous solution containing 1% w/v of the same polyethylene imine as was used in Example 1 in an amount such that there was present in each case 0.15% by weight of polyethylene imine based on the weight of dry kaolin, which quantity was found in Example 2 to be the optimum for this particular kaolin.

After treatment with the polyethylene imine each portion of aqueous suspension was filtered and the first portion of filter cake was dried at 80° C. to zero moisture content. The second portion of filter cake, however, was dried only until the moisture content was 10% by weight. The 5 poise viscosity concentration was measured for the untreated and treated kaolin samples and the results obtained are set forth in Table VII below.

Table VII

| Amount of polyethylene imine (% by wt. based on wt. of dry kaolin) | 5 poise viscosity concentration |
|---|---|
| 0 | 66.2 |
| 0.15 (dried to 0% by wt. moisture) | 69.6 |
| 0.15 (dried to 10% by wt. moisture) | 69.3 |

Both the treated samples show approximately the same improvement in 5 poise viscosity concentration and it is not necessary, therefore, to remove all the water in order to achieve a good improvement in rheological properties.

EXAMPLE 8

The same kaolin as was used in Example 2 was refined, using the same sodium polyacrylate deflocculant which was described in Example 2, so as to have a particle size distribution such that 80% by weight consisted of particles smaller than 2 microns equivalent spherical diameter. The resultant aqueous suspension of refined kaolin had a solids content of 10% by weight and its pH was adjusted to 4.5 with dilute sulphuric acid. The aqueous suspension was then divided into two portions. The first portion was filtered and the cake thus obtained was dried for a short time until the moisture content was 28% by weight. The resultant plastic material was then subjected to mechanical working in an auger-type pugmill at different levels of energy dissipation and the mechanically worked samples were tested for 5 poise viscosity concentration.

The second portion was treated with sufficient of a 1% aqueous solution of the same polyethylene imine as was used in Example 1 to provide 0.15% by weight of the polyethylene imine based on the weight of dry kaolin, which dose had been found to be the optimum for the particular kaolin. The pH of the polyethylene imine solution was 6.0. The resulting mixture was stirred for ½ minute, filtered and the cake of treated kaolin thus obtained dried for a short time until the moisture content was 28% by weight. The resultant plastic material was then subjected to mechanical working in an auger-type pugmill at different levels of energy dissipation and the mechanically worked samples were tested for 5 poise viscosity concentration.

The results obtained are set forth in Table VIII below.

Table VIII

| | Energy dissipated (KJ per kg. of dry kaolin) | 5 poise viscosity concentration |
|---|---|---|
| Untreated Kaolin | 0 | 66.2 |
| | 77 | 67.6 |
| | 177 | 68.9 |
| | 294 | 69.0 |
| Kaolin treated with polyethylene imine | 0 | 69.6 |
| | 122 | 70.5 |
| | 193 | 71.2 |
| | 230 | 71.3 |
| | 283 | 71.7 |

The results show that further improvements in rheological properties can be obtained if kaolin which has been treated with polyethylene imine in accordance with the invention is subsequently subjected to a mechanical working step.

EXAMPLE 9

Samples of a kaolin which had been refined (using as deflocculant the same sodium polyacrylate as was used in Example 2) so as to have a particle size distribution such that 80% by weight consisted of particles smaller than 2 microns equivalent spherical diameter were treated with the same polyethylene imine and in the same manner as described in Example 1. The 5 poise viscosity concentration was measured for the untreated and treated kaolin samples and also the permeability to water of a filter cake formed from the kaolin suspension at a pressure differential of 100 psi. (measured as cubic inches of water per hour per cubic inch of filter cake per pound per square inch pressure across the filter cake).

The results obtained are set forth in Table IX below:

Table IX

| Amount of polyethylene imine (% by wt. based on wt. of dry kaolin) | 5 poise viscosity concentration | Permeability (cu. in/hr/ $in^3$/psi) |
|---|---|---|
| 0 | 65.7 | 0.0069 |
| 0.1 | 68.6 | 0.0200 |
| 0.15 | 69.6 | 0.0259 |
| 0.2 | 68.1 | 0.0275 |

The apparatus for measuring permeability consisted of a cylindrical vessel in which a closely fitting piston could slide, the ends of the cylindrical vessel being closed by screw-threaded end caps. In one end cap there was provided an outlet conduit for filtrate the opening to which conduit as covered by a piece of wire gauze surmounted by a piece of filter cloth which together acted as a filter medium on which a filter cake could be built up. The other end cap was provided with a conduit through which hydraulic fluid could be supplied at an elevated pressure.

In operation, the end cap comprising the filter medium was unscrewed and a sample of the slurry to be tested was introduced into the cavity between the upper end of the piston and the filter medium. Hydraulic fluid at the required pressure was then introduced into the cavity between the other end of the piston and the other end cap, pressure being thereby applied to the slurry. Filtrate expressed through the filter medium was collected in a graduated cylinder and the volume of filtrate collected after given intervals of time was observed. A graph was then plotted of $t/V$ against V, where V is the volume of filtrate collected after time, $t$. A straight line was obtained and the slope, $m$, was estimated.

The permeability, $p$, was calculated from the expression $$p = \frac{v}{2A^2 \cdot \Delta P \cdot m}$$

where $\Delta P$ is the pressure drop across the filter medium and the cake;

A is the surface area of the filter medium perpendicular to the direction of flow of filtrate; and $v$ is the volume of cake deposited per unit volume of filtrate and is given by the expression $$v = \frac{d_s - d_f}{d_c - d_s}$$

where $d_s$ is the specific gravity of the feed slurry;

$d_f$ is the specific gravity of the filtrate; and $d_c$ is the specific gravity of the filter cake.

Clay minerals treated in accordance with the process of the present invention are suitable for incorporation in paper coating compositions together with an adhesive and an aqueous carrier, e.g., water. The clay minerals may be used as the sole pigment in such a composition, or they may be used in admixture with other pigments, e.g., precipitated calcium carbonate, natural chalk whiting or satin white. The adhesive may be amylaceous, proteinaceous or a synthetic resin latex.

What is claimed is:

1. A process for reducing the viscosity at a given solids content of an aqueous suspension of a clay mineral for use as a pigment in a paper coating composition, which process consists essentially of the step of mixing an aqueous suspension of the clay mineral at a solids content in the range of from 5 to 30% by weight and at a pH of from 4.5 to 6.0 with from 0.05 to 0.25% by weight of a water-soluble compound having a plurality of basic groups and a number average molecular weight not greater than 1000 selected from the group consisting of polyethylene imine, ethylene diamine, 1:12 dodecane diamine, diethylene triamine, tetraethylene pentamine, and hexamethylene tetramine.

2. A process according to claim 1 wherein the water-soluble compound is mixed with the aqueous suspension of the clay mineral in the form of a dilute aqueous solution.

3. A process according to claim 1, wherein said solids content is in the range of from 10 to 20% by weight.

4. A process according to claim 2, wherein the pH of said dilute aqueous solution is adjusted to a value in the range of from 4.5 to 6.0 prior to being mixed with the aqueous suspension of the clay mineral.

5. A process according to claim 1, wherein the clay mineral is a clay of the kandite group.

6. A process according to claim 1, wherein the clay mineral is a clay of the smectite group.

7. A process according to claim 1, wherein the clay mineral is an illite.

8. A process according to claim 5, wherein the clay mineral is a kaolin.

9. A process according to claim 2, wherein the water-soluble compound has a number average molecular weight of from 500 to 1,000, and wherein said aqueous solution contains from 0.1 to 20% by weight of the water-soluble compound per volume of solution.

10. A process according to claim 9, wherein said aqueous solution contains from 0.5 to 5% by weight of said water-soluble compound per volume of solution.

11. A process according to claim 1, wherein the clay mineral, after being mixed with the water-soluble compound, is subjected to mechanical working in the plastic state.

12. A process according to claim 11, wherein there is dissipated, during said mechanical working, from 25 to 1,000 KJ of energy per kg of dry clay mineral.

13. A process according to claim 12, wherein there is dissipated, during said mechanical working, from 100 to 300 KJ of energy per kg of dry clay mineral.

* * * * *